United States Patent [19]

Vollrath

[11] 4,272,866

[45] Jun. 16, 1981

[54] WEB GUIDING DEVICE FOR A CARDING MACHINE

[75] Inventor: Ulrich Vollrath, Neuss, Fed. Rep. of Germany

[73] Assignee: Trützschler GmbH & Co. KG, Monchen-Gladbach, Fed. Rep. of Germany

[21] Appl. No.: 83,560

[22] Filed: Oct. 10, 1979

[30] Foreign Application Priority Data

Oct. 23, 1978 [DE] Fed. Rep. of Germany ..... 2846137

[51] Int. Cl.[3] ..... D01G 15/46

[52] U.S. Cl. ..... 19/150; 19/106 R

[58] Field of Search ..... 19/106 R, 106 A, 150

[56] References Cited

U.S. PATENT DOCUMENTS

| | | | |
|---|---|---|---|
| 1,448,191 | 3/1923 | Butler | 19/150 |
| 2,118,975 | 5/1938 | Hunt | 19/106 A |
| 2,897,549 | 8/1959 | Paterson | 19/150 |

FOREIGN PATENT DOCUMENTS

| | | | |
|---|---|---|---|
| 637870 | 5/1950 | United Kingdom | 19/106 R |

*Primary Examiner*—Louis Rimrodt

*Attorney, Agent, or Firm*—Spencer & Kaye

[57] ABSTRACT

A carding machine has a web delivering assembly including cooperating upper and lower rollers and a web guiding device for withdrawing and gathering a fiber web discharged by the web delivering assembly. The web guiding device includes a guide element arranged immediately downstream of the rollers as viewed in the direction of advance of the fiber web. The guide element has at least one operationally stationary guide face extending transversely to the plane in which the fiber web advances. The guide element further has an upper longitudinal edge extending along the upper roller in the immediate vicinity thereof and a lower longitudinal edge extending along the lower roller at a sufficient distance therefrom for allowing waste to drop out downwardly from the fiber web as is passes from the rollers to the guide element.

6 Claims, 9 Drawing Figures

WEB GUIDING DEVICE FOR A CARDING MACHINE

BACKGROUND OF THE INVENTION

This invention relates to a web guiding device mounted in a carding machine for withdrawing and gathering a fiber web discharged by a web delivering assembly of a carding machine. The web delivering assembly comprises a roller pair (such as squeezing rollers). The web guiding device comprises a guide element arranged immediately downstream of the roller pair as viewed in the direction of web discharge. The guide element has at least one operationally stationary guide face which traverses the plane of the fiber web and further, the upper longitudinal edge of the guide element extends immediately adjacent and along the upper roller of the roller pair.

In a known arrangement, the lower longitudinal edge of the guide element is arranged immediately adjacent and along the lower roller of the roller pair. Such an arrangement is disadvantageous because particularly in case of heavily soiled cotton, the impurities or waste crushed by the squeezing rollers do not drop downwardly out of the arrangement, but accumulate at the inside of the lower, curved zone of the guide face.

SUMMARY OF THE INVENTION

It is an object of the invention to provide an improved web guiding device of the above-outlined type, by means of which an accumulation of waste on the guide face of the guide element is prevented.

This object and others to become apparent as the specification progresses are accomplished by the invention, according to which, briefly stated, the longitudinal lower edge of the guide element is arranged at a sufficient distance from the lower roller of the roller pair of the web delivering assembly for allowing waste to drop out of the guide element.

The guide element according to the invention thus has three zones: an upper curved, closed zone which shields the fiber web from above, thus preventing air streams from entering the guide element from above. Such air streams are particularly adversely affecting the marginal zones of the fiber web. The upper closed zone of the guide element is adjoined by a central zone which, in turn, is followed by a lower, open zone. The latter provides that waste can freely fall downward from the squeezing rollers.

According to a preferred embodiment, the guide face extends from the central zone downwardly in a vertical direction. Such a planar configuration is simple to manufacture. Further, by prolonging the guide face downwardly, additional air streams may be prevented from entering the space between the roller pair and the guide element.

According to another preferred embodiment, the open, lower zone of the guide face has such a downwardly inclined course that the waste may slide downwardly thereon. By inclining the guide face in the direction of the rollers, again, additional air streams may be screened off.

DESCRIPTION OF THE PREFERRED EMBODIMENTS

Figure 1:
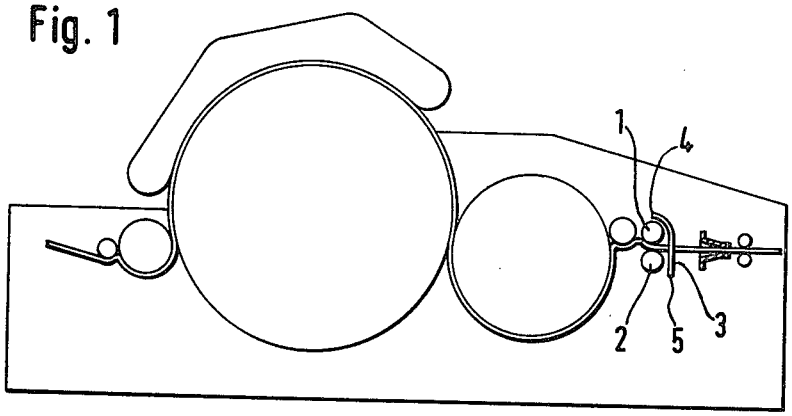
FIG. 1 is a schematic side elevational view of a carding machine incorporating a preferred embodiment of the invention.
Figure 2:
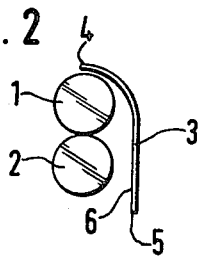
FIG. 2 is an enlarged schematic side elevational view of a detail of FIG. 1.

Turning now to FIG. 1, there is schematically illustrated a carding machine which has a web delivering assembly including two squeezing rollers 1 and 2, downstream of which (as viewed in the direction of web advance) there is arranged a web guiding element 3. The longitudinal upper edge 4 of the guide element 3 is slightly spaced from the upper roller 1 and projects, in an upstream direction, beyond the highest point thereof. The lower longitudinal edge 5 of the guide element is situated at a distance from the surface of the lower roller 2. As shown in FIGS. 1 and 2, the guide face 6 of the guide element 3 extends vertically downwardly, while the upper curved zone of the guide element is adjoined by a planar zone. The guide face 6 is prolonged downwardly, that is, the lower longitudinal edge 5 is situated at a lower level than the lowermost point of the lower roller 2. The distance between the upper longitudinal edge 4 and the surface of the upper roller is, for example approximately 2.5 to 5 mm, while the distance between the planar zone of the guide face 6 and the periphery of the lower roller 2 is approximately 30 to 40 mm.

Figure 3:
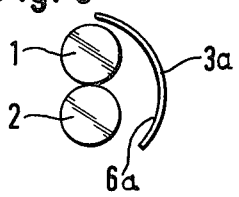
FIGS. 3 and 4 are schematic side elevational views of two further preferred embodiments of the invention.

In the embodiment illustrated in FIG. 3, the guide face 6*a* of the guide element 3*a* is inclined downwardly in the direction of the squeezing rollers 1 and 2. Such an arrangement provides that waste material can slide downwardly on the inner face of the guide face 6*a*.

Figure 4:
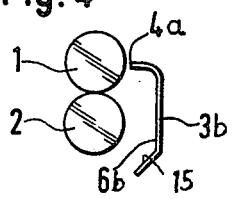

In the embodiment illustrated in FIG. 4, the upper longitudinal edge 4*a* of the guide element 3*b* is situated approximately at the height level of the center point of the surface of the upper roller 1. The vertically oriented planar central zone of the guide face 6*b* is adjoined by an obliquely oriented planar lower zone 15 which is inclined in the direction of the rollers 1 and 2.

Figure 5:
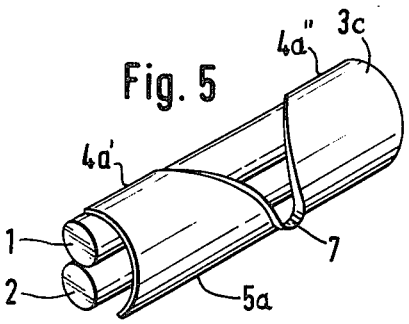
FIG. 5 is a schematic perspective view of an additional preferred embodiment of the invention.

In the embodiment illustrated in FIG. 5, the central zone of the guide element 3*c* is provided with an opening 7 for delivering the sliver formed from the fiber web. The opening widens in a V shape upwardly and terminates on the one and the other side of the guide element in longitudinal edges 4*a*′ and 4*a*″ respectively. The longitudinal edges 4*a*′ and 4*a*″ extend, similarly to the longitudinal edge 4 in the embodiment discussed in connection with FIGS. 1 and 2, beyond the uppermost point of the top of the upper roller 1. The lower longitudinal edge 5*a* of the guide element 3*c* is situated at a distance from the lower roller 2.

Figure 6A:
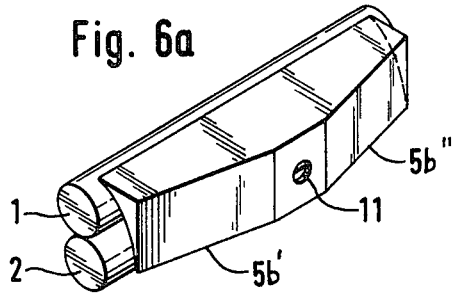
FIGS. 6*a* and 6*b* are schematic perspective and top plan views of still a further preferred embodiment of the invention.
Figure 6B:
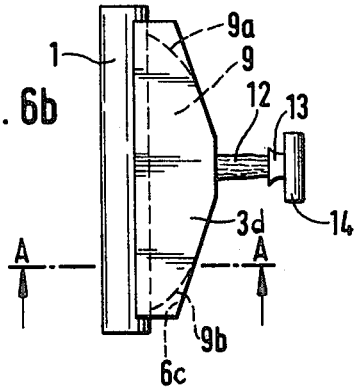
Figure 6C:
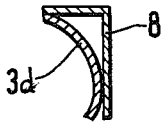
FIG. 6*c* is a sectional view taken along line A—A of FIG. 6*b*.
Figure 6D:
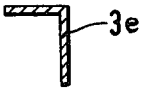
FIG. 6*d* is a sectional view of a modified part of the embodiment shown in FIGS. 6*a*–6*c*.

Turning now to FIG. 6*a*, there is shown a further embodiment in a perspective view, wherein the lower longitudinal edges 5*b*′ and 5*b*″ form two acute angles with the longitudinal axes of the squeezing rollers 1 and 2. As seen in FIG. 6*b*, the fiber web 9 leaves the squeezing roller pair (of which only the upper squeezing roller 1 is shown) and impinges, with its edges 9*a*, 9*b* (shown in phantom lines) on the guide face 6*c* of the guide element 3*d* and, as a result, it is rolled inwardly and gathered and thereafter leaves the guide element 3*d* as a sliver 12 through the opening 11. The sliver 12 passes through a trumpet 13 and a calender roller pair (of which only one roller 14 is shown). The guide element 3*d* is downwardly open, so that waste may fall downwardly from the fiber web 9. The lower longitudinal edges 5*b*′ and 5*b*″ are arranged at such an acute angle with respect to the longitudinal axes of the squeezing rollers 1, 2 that, on the one hand, the edges 9*a* and 9*b* of the fiber web 9 impinge on the guide face 6*c* and are deflected by the latter and, on the other hand, the fiber web 9 is still open, that is, it has a quasi-triangular shape. In its state between the squeezing rollers 1 and 2 and trumpet 13 the fiber web is extremely thin; it is formed of interhooked individual fibers and thus is relatively open so that waste particles and other impurities may readily be released thereby. FIG. 6*c* shows in cross section the curved guide element 3*d* which is surrounded by a rectangular supporting housing 8. FIG. 6*d* shows in cross section a rectangular guide element 3*e* which may be substituted for the guide element 3*d*.

It will be understood that the above description of the present invention is susceptible to various modifications, changes and adaptations, and the same are intended to be comprehended within the meaning and range of equivalents of the appended claims.

What is claimed is:

1. In a carding machine having a web delivering assembly including cooperating upper and lower rollers; a web guiding device for withdrawing and gathering a fiber web discharged by the web delivering assembly; the web guiding device including a guide element arranged immediately downstream of the rollers as viewed in the direction of advance of the fiber web; the guide element having at least one operationally stationary guide face extending transversely to the plane in which the fiber web advances; the guide element further having an upper longitudinal edge extending along the upper roller in the immediate vicinity thereof; the improvement wherein said guide element has a lower longitudinal edge extending along said lower roller at a sufficient distance therefrom for allowing waste to drop out downwardly from the fiber web as it passes from said rollers to said guide element.

2. A carding machine as defined in claim 1, wherein said guide element is downwardly open.

3. A carding machine as defined in claim 1, wherein said guide face has a planar, vertical zone.

4. A carding machine as defined in claim 1, wherein said guide face extends below the level of the lowermost points of said lower roller.

5. A carding machine as defined in claim 1, wherein said guide face has a lower portion inclined downwardly in the direction of said rollers for providing a slide for the waste.

6. A carding machine as defined in claim 1, wherein said lower longitudinal edge has first and second length portions extending, from a central part of the guide element, towards respective opposite ends of said rollers at an acute angle with respect to axes of said rollers.

* * * * *